US009639018B2

(12) United States Patent
Miyamoto

(10) Patent No.: US 9,639,018 B2
(45) Date of Patent: May 2, 2017

(54) ELECTROSTATIC LATENT IMAGE DEVELOPING TONER

(71) Applicant: KYOCERA Document Solutions Inc., Osaka (JP)

(72) Inventor: Hidetoshi Miyamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/163,293

(22) Filed: May 24, 2016

(65) Prior Publication Data

US 2016/0349648 A1 Dec. 1, 2016

(30) Foreign Application Priority Data

May 26, 2015 (JP) ..... 2015-106443
May 20, 2016 (JP) ..... 2016-101326

(51) Int. Cl.
*G03G 9/093* (2006.01)
*G03G 9/08* (2006.01)
*G03G 9/087* (2006.01)

(52) U.S. Cl.
CPC ..... *G03G 9/093* (2013.01); *G03G 9/0819* (2013.01); *G03G 9/08726* (2013.01); *G03G 9/0935* (2013.01); *G03G 9/09307* (2013.01); *G03G 9/09321* (2013.01); *G03G 9/09371* (2013.01); *G03G 9/09392* (2013.01)

(58) Field of Classification Search
CPC ..... G03G 9/09307
See application file for complete search history.

(56) References Cited

U.S. PATENT DOCUMENTS

2006/0204881 A1* 9/2006 Ota ..... G03G 9/09335 430/110.2
2008/0057434 A1* 3/2008 Itoh ..... G03G 9/0806 430/137.15
2015/0253688 A1* 9/2015 Yamauchi ..... G03G 9/09328 430/105
2016/0187796 A1* 6/2016 Tsujihiro ..... G03G 9/09321 430/110.2

FOREIGN PATENT DOCUMENTS

JP 2013-011644 A 1/2013

* cited by examiner

*Primary Examiner* — Hoa V Le
(74) *Attorney, Agent, or Firm* — Studebaker & Brackett PC

(57) ABSTRACT

An electrostatic latent image developing toner includes a plurality of toner particles each including a toner core and a shell layer. The shell layer includes a plurality of first shell particles and a plurality of second shell particles. The first shell particles cover the toner core at a coverage of at least 25% and no greater than 50%. The second shell particles additionally cover the toner cores at a coverage of at least 5% and no greater than 30%. An SP value of the toner core is greater than an SP value of the first shell particles. The SP value of the first shell particles is greater than an SP value of the second shell particles.

8 Claims, 2 Drawing Sheets

ELECTROSTATIC LATENT IMAGE DEVELOPING TONER

INCORPORATION BY REFERENCE

The present application claims priority under 35 U.S.C. §119 to Japanese Patent Application No. 2015-106443, filed on May 26, 2015 and Japanese Patent Application No. 2016-101326, filed on May 20, 2016. The contents of these applications are incorporated herein by reference in their entirety.

BACKGROUND

The present disclosure relates to an electrostatic latent image developing toner.

A toner has been known that includes toner particles each including a toner core that contains a styrene-acrylic acid-based modified polyester resin and shell particles that cover the toner core and that each contain a styrene-acrylic acid-based resin as a major component. In a toner as above, the shell particles are solidified on the surface layer of the toner core by partial phase dissolution of the styrene-acrylic acid-based component of the toner core and the styrene-acrylic acid-based component of the shell particles. Solidification of the shell particles on the surface layer of the toner core forms projections and recesses on the surfaces of the toner particles.

SUMMARY

An electrostatic latent image developing toner according to the present disclosure includes a plurality of toner particles each including a toner core and a shell layer that covers a surface of the toner core. The shell layer includes a plurality of first shell particles and a plurality of second shell particles. The first shell particles cover the surface of the toner core. The second shell particles additionally cover the toner core covered with the first shell particles. The first shell particles have a coverage ($C_F$) that satisfies the following expression (1). The second shell particles have a coverage ($C_S$) that satisfies the following expression (2). A solubility parameter ($SP_T$) of the toner core, a solubility parameter ($SP_F$) of the first shell particles, and a solubility parameter (SP,) of the second shell particles satisfy the following expression (3).

$$25\% \leq C_F \leq 50\% \quad (1)$$

$$5\% \leq C_S \leq 30\% \quad (2)$$

$$SP_T > SP_F > SP_S \quad (3)$$

DETAILED DESCRIPTION

Hereinafter, an embodiment of the present disclosure will be described. The present disclosure is not in any way limited by the following embodiment, and appropriate changes may be made when practicing the present disclosure so long as such changes do not deviate from the intended scope of the present disclosure. Although description is omitted as appropriate in some instances in order to avoid repetition, such omission does not limit the essence of the present disclosure.

An electrostatic latent image developing toner (also referred to below as a toner) according to the present embodiment is a powder of multiple toner particles. The toner particles included in the toner of the present embodiment each include a toner core and a shell layer disposed over a surface of the toner core. An external additive may be attached to a surface of the shell layer. The external additive may be omitted in a situation in which such an additive is not necessary. Hereinafter, toner particles that are yet to be subjected to addition of an external additive may be referred to as toner mother particles. Also, a material for forming the shell layers is referred to as a shell material. The toner according to the present embodiment can be used for example in an electrophotographic apparatus (image forming apparatus).

An image forming apparatus develops an electrostatic latent image with a developer containing a toner. In a configuration in which the image forming apparatus adopts for example an intermediate transfer process, a toner image is formed by attaching charged toner to an electrostatic latent image formed on a photosensitive member in a developing process. In a subsequent transfer process, the toner image is transferred to an intermediate transfer member (for example, an intermediate transfer belt) and the toner image on the intermediate transfer member is further transferred to a recording medium (for example, paper). Thereafter, the toner is fixed to the recording medium by heating the toner. Through the above, an image is formed on the recording medium. A full-color image can for example be formed by superimposing toner images of four colors: black, yellow, magenta, and cyan.

Figure 1:
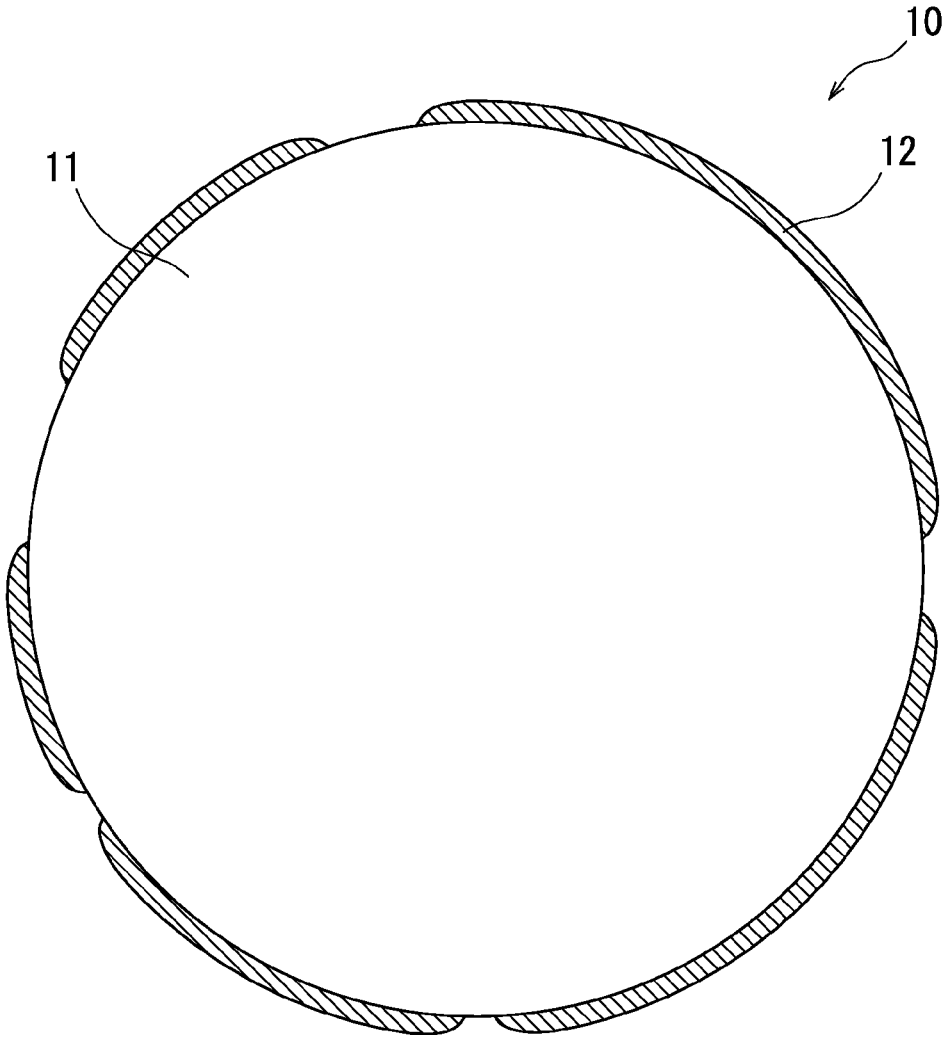
FIG. 1 illustrates an example configuration in section of a toner particle included in an electrostatic latent image developing toner according to an embodiment of the present disclosure.

The toner particles of the toner according to the present embodiment each include a toner core and a shell layer. Following describes an example configuration of a toner particle (specifically, a toner mother particle) of the toner in the present embodiment with reference to FIG. 1. FIG. 1 illustrates an example configuration in section of a toner particle included in the toner according to the present embodiment. A toner mother particle 10 illustrated in FIG. 1 includes a toner core 11 and a shell layer 12 that covers a surface of the toner core 11. The toner core 11 is partially covered with the shell layer 12 such that a part of the surface of the toner core 11 is exposed.

Figure 2:
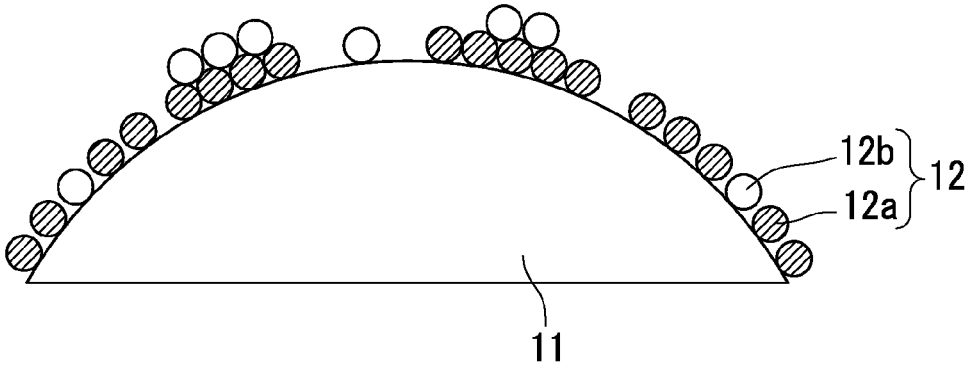
FIG. 2 is an enlarged diagram illustrating of a part of a surface of the mother toner particle illustrated in FIG. 1.

Description will be further made with reference to FIG. 2 about a state in which the shell layer 12 covers the toner core 11. FIG. 2 is an enlarged diagram illustrating a part of the surface of the toner mother particle 10 illustrated in FIG. 1. The shell layer 12 includes a plurality of first shell particles 12*a* and a plurality of second shell particles 12*b*. The first shell particles 12*a* covers the surface of the toner core 11. The second shell particles 12*b* additionally covers the toner core 11 covered with the first shell particles 12*a*. The second shell particles 12*b* are attached to the first shell particles 12*a*. The second shell particles 12*b* may be attached to the surface of the toner core 11.

The shell layer 12 is thought to have a configuration in which the first shell particles 12*a* are two-dimensionally connected together and the second shell particles 12*b* are two-dimensionally connected together. The first shell particles 12*a* and the second shell particles 12*b* may be in contact with or separate from one another. In a configuration in which the first shell particles 12*a* and the second shell particles 12*b* are in contact with one another, they may be in physical contact with one another. Alternatively, contact surfaces of the first shell particles 12*a* and the second shell particles 12*b* are melt and dissolved.

The toner according to the present embodiment satisfies the following conditions (1).

Conditions (1): The first shell particles cover a surface of the toner core. The second shell particles additionally cover the toner core covered with the first shell particles. The first shell particles have a coverage ($C_F$) that satisfies the following expression (1). The second shell particles have a coverage ($C_S$) that satisfies the following expression (2). A solubility parameter ($SP_T$) of the toner cores, a solubility parameter ($SP_F$) of the first shell particles, and a solubility parameter ($SP_S$) of the second shell particles satisfy the following expression (3).

$$25\% \leq C_F \leq 50\% \quad (1)$$

$$5\% \leq C_S \leq 30\% \quad (2)$$

$$SP_T > SP_F > SP_S \quad (3)$$

$C_F$ represents an area rate of the first shell particles covering a toner core relative to an entire surface of the toner core covered with the first shell particles. $C_S$ represents an area rate of the second shell particles present on a surface of a toner particle relative to the entire surface of the toner particle. The coverage $C_F$ and $C_S$ can be each measured based on a backscattered electron image taken using a scanning electron microscope (for example, JSM-7600F produced by JEOL Ltd.). Respective methods for measuring $C_F$ and $C_S$ will be described later in detail. Note that $C_F$ can be measured after the second shell particles are attached to the toner particles. For example, the coverage ($C_F$) of the first shell particles may be calculated from toner particles including the second shell particles through elimination of an influence of the second shell particles. Alternatively, $C_F$ may be measured for toner particles from which the second shell particles are removed.

The solubility parameter (SP value) is a characteristic value that indicates a compatibility. The SP value is expressed by a square root of a cohesive energy density (CED). Note that the CED means an amount of energy necessary for evaporating molecules of 1 mL. A method for calculating an SP value will be described below with reference to Documents A and B listed below.

Document A: R. F. Fedors (1974). *Polymer engineering and science*, Vol. 14, Second, pp. 147-154

Document B: Minoru Imoto (1993). *Basic Theory of Bonding*. Kobunshi Kankokai

The SP value is expressed by an expression "SP value= $(E/V)^{1/2}$, where E represents a molecular cohesive energy (unit: cal/mol) and V represents a molecular volume (unit: $cm^3$/mol). E (molecular cohesive energy) in the expression is expressed by an expression "$E=\Sigma\Delta ei$", where $\Delta ei$ represents an evaporation energy of an atomic group. V (molecular volume) in the expression is expressed by an expression "$V=\Sigma\Delta vi$, where $\Delta vi$ represents a mole volume of an atomic group. The SP value can be calculated using a value of evaporation energy by Fedors (see Document A) and respective data of $\Delta ei$ and $\Delta vi$ recited in Document B. For example, in a situation in which $SP_T$ is calculated, the respective atomic groups in $\Delta ei$ and $\Delta vi$ correspond to atomic groups contained in a binder resin that forms the toner cores.

Following describes a method for adjusting an SP value (specifically $SP_T$, $SP_F$, or $SP_S$). The SP value tends to decrease as a resin (resin forming the toner cores, the first shell particles, or the second shell particles) is strongly hydrophobic and increase as the resin is strongly hydrophilic. The SP value of the resin can be adjusted for example by changing a rate of a repeating unit in the resin or introducing a cross-linking structure or a substituent for the resin. In a situation in which a substituent is introduced into the resin, the SP value of the resin can be adjusted by changing the type or number of substituents to be introduced. For example, introduction of a hydrophobic substituent into the resin can decrease the SP value of the resin. Examples of the hydrophobic substituent include alkyl groups, alkenyl groups, alkynyl groups, and aryl groups. Alternatively, introduction of a hydrophilic substituent into the resin can increase the SP value of the resin. Examples of the hydrophilic substituent include hydroxyl groups, carboxyl groups, cyano groups, nitro groups, and amino groups.

Furthermore, introduction of a cross-linking structure into the resin can decrease the SP value of the resin. Examples crosslinking agent that can be used for introducing a cross-linking structure may be crosslinkable monomers. Examples of the crosslinkable monomers include divinylbenzene-based crosslinkable monomers, diallyl phthalate-based crosslinkable monomers, and dimethacrylic acid ester-based crosslinkable monomers. Examples of divinylbenzene-based crosslinkable monomers include o-divinylbenzene, m-divinylbenzene, and p-divinylbenzene. Examples of diallyl phthalate-based crosslinkable monomers include diallyl isophthalate and diallyl ortho phthalate. Examples of dimethacrylic acid ester-based crosslinkable monomers include ethylene glycol dimethacrylate and triethylene glycol dimethacrylate.

In a configuration in which the resin is a copolymer, the SP value of the resin can be adjusted by changing the ratio between two or more types of repeating units contained in the resin. For example, the SP value of the resin can be decreased by increasing a rate of a hydrophobic repeating unit in the resin. Alternatively, the SP value of the resin can be increased by increasing the rate of a hydrophilic repeating unit in the resin. For example, in a configuration in which the resin is a styrene-acrylic acid-based resin, increasing a rate of a repeating unit originated from a styrene-based monomer decreases the SP value of the resin and decreasing a rate of a repeating unit originated from an acrylic acid-based monomer increases the SP value of the resin.

The toner that satisfies conditions (1) satisfies expression (3). It is thought that when $SP_T > SP_F > SP_S$ is satisfied, adhesion strength of the first shell particles to a toner core is stronger than adhesion strength of the second shell particles to the toner core and adhesion strength of the second shell particles to the first shell particles is stronger than adhesion strength of the second shell particles to the toner core. In the above configuration, it is thought that the first shell particles tend to be attached to the toner cores more than the second shell particles. Furthermore, it is thought that the second shell particles tend to be attached to the first shell particles more than to the toner cores.

Conditions (1) are effective for improving both low-temperature fixability and high-temperature preservability of the toner. Specifically, when the toner cores are each covered with the first and second shell particles, agglomeration of the toner particles is thought to be inhibited, thereby improving high-temperature preservability of the toner. However, in a configuration in which the coverage of the shell particles is too high, the toner may have insufficient low-temperature fixability. In the toner that satisfies conditions (1), $C_F$ is at least 25% and no greater than 50% and $C_s$ is at least 5% and no greater than 30%. The inventor has found that a toner in which $C_F$ and $C_s$ fall in the respective ranges is excellent in low-temperature fixability and high-temperature preservability. In a configuration in which the second shell particles cover each of the toner cores as a layer located over the first shell particles, satisfactory high-temperature preservability of the toner can be ensured even in a configuration in which the coverage ($C_F$) of the first shell particles is low. In a configuration in which the coverage ($C_F$) of the first shell particles is low, satisfactory low-temperature fixability can be ensured. Adhesion strength of the second shell particles to the toner cores is weaker than adhesion strength of the first shell particles to the toner cores. In the above configuration, the second shell particles tend to separate from the toner particles in toner fixing. Therefore, the toner tends to melt and spread when passing through a nip part in a fixing process. In a configuration in which conditions (1) are satisfied, both low-temperature fixability and high-temperature preservability of the toner can be improved more easily than in a situation in which low-temperature fixability and high-temperature preservability of the toner are improved by precisely adjusting the film thickness of a single shell layer. In order to further improve both low-temperature fixability and high-temperature preservability of the toner, preferably, $C_F$ is at least 30% and no greater than 45% and $C_S$ is at least 10% and no greater than 25%.

The use of the toner that satisfies conditions (1) enables image formation at appropriate image density for a long period of term. The toner that satisfies conditions (1) satisfies expression (3). Accordingly, it is thought that in a situation in which an image is formed using the toner, the first and second shell particles hardly separate from the surfaces of the toner particles. Furthermore, it is thought that in a configuration in which the first and second shell particles are inhibited from separating from the surfaces of the toner particles, decrease in image density, which is caused due to occurrence of filming (attachment of shell particles to for example a development roller, a photosensitive member, or a carrier), can be inhibited. As such, it is thought that the use of the toner that satisfies conditions (1) enables image formation at appropriate image density for a long period of term.

Moreover, in a configuration in which a cross-linking structure is introduced into the resin that forms shell particles (specifically, the first or second shell particles), the hardness of the shell particles tends to increase. In a configuration in which the shell particles have high hardness, filming may hardly occur even in a situation in which the shell particles receive external stress and separate from the toner particles.

In order to improve adhesion strength of the first shell particles to the toner cores, $SP_T$ and $SP_F$ preferably satisfy the following expression (4) and it is more preferable that $|SP_T-SP_F|$ is no greater than 0.4. In a configuration in which $SP_T$ and $SP_F$ satisfy expression (4), the first shell particles tend to adhere to the surfaces of the toner cores and hardly separate from the toner particles. Further, in order to improve adhesion strength of the second shell particles to the first shell particles, $SP_F$ and $SP_S$ preferably satisfy expression (5) and it is more preferable that $|SP_F-SP_S|$ is no greater than 0.4. In a configuration in which $SP_F$ and $SP_S$ satisfy expression (5), the second shell particles tend to adhere to the first shell particles covering the toner cores and hardly separate from the toner particles. Inhibiting separation of the shell particles can result in inhibition of occurrence of filming.

$$|SP_T-SP_F|\leq 1.0 \quad (4)$$

$$|SP_F-SP_S|\leq 1.0 \quad (5)$$

Adhesion strength between particles (specifically, two types of particles selected from the toner cores, the first shell particles, and the second shell particles) varies depending also on particle diameters of the respective particles (for example, respective number average particle diameters). Following describes the number average particle diameters preferable for the respective particles. Note that the number average particle diameter means a number average value of equivalent circular diameters of an appropriate number of particles (diameter of a circle having the same surface area as projections of the respective particles). The number average particle diameter can be measured from a transmission electron microscope (TEM) photograph of the particles taken using a TEM. In the present specification, the term "a number average particle diameter" means a number average primary particle diameter.

In order to inhibit occurrence of filming, the respective number average particle diameters of the first and second shell particles are preferably at least 0.005 times and no greater than 0.04 times as the number average particle diameter of the toner cores. The number average particle diameter of the first shell particles is preferably smaller than that of the second shell particles. In a configuration in which the number average particle diameter of the first shell particles is smaller than that of the second shell particles, both low-temperature fixability and high-temperature preservability of the toner can be improved.

The number average particle diameter of the first shell particles is preferably at least 30 nm and no greater than 90 nm, more preferably at least 30 nm and no greater than 80 nm, and further more preferably at least 30 nm and no greater than 50 nm in order to improve charge stability and low-temperature fixability of the toner. In a configuration in which the number average particle diameter of the first shell particles is at least 30 nm, the amount of a surfactant used in producing the first shell particles can be reduced. A reduced amount of the surfactant can inhibit decrease in charge stability of the toner under influence of the surfactant. Furthermore, in a configuration in which the number average particle diameter of the first shell particles is at least 90 nm (preferably, at least 80 nm, and more preferably, at least 50 nm), the toner tends to have excellent low-temperature fixability. The reason thereof may be such that heat is readily transmitted to the toner cores in toner fixing.

The number average particle diameter of the second shell particles is preferably at least 70 nm and no greater than 300 nm, and more preferably at least 70 nm and no greater than 150 nm in order to improve charge stability of the toner. In a configuration in which the number average particle diameter of the second shell particles is at least 70 nm, the second shell particles tend to have high hardness. In a configuration in which the second shell particles have high hardness, a situation in which adhesion strength of the second shell particles to the toner cores is too strong can be prevented. In a configuration in which the number average particle diameter of the second shell particles is at least 300 nm, the second shell particles hardly separate from the toner particles.

The toner may be used as a one component developer. Alternatively, the toner may be used in a two-component developer through mixing with a desired carrier.

Following describes the toner cores, the shell layer, and an external additive. Note that the term "(meth)acryl" may be used as a generic term for both acryl and methacryl. Furthermore, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

[Toner Cores]

The toner cores each contain a binder resin. The toner cores may each optionally contain an internal additive (for example, a colorant, a releasing agent, a charge control agent, or a magnetic powder) in addition to the binder resin. Following describes the binder resin, the colorant, the releasing agent, the charge control agent, and the magnetic powder.

(Binder Resin)

The binder resin is a major component (for example, at least 85% by mass) of the toner cores. Properties of the binder resin are therefore expected to have great influence on an overall property of the toner cores. For example, in a configuration in which the binder resin has an ester group, a hydroxyl group, an ether group, an acid group (more specifically, a carboxyl group or the like), or a methyl group, the toner cores are highly likely to be anionic. In a configuration in which the binder resin has an amino group or an amide group, the toner cores are highly likely to be cationic. In order that the binder resin is strongly anionic, the binder resin preferably has a hydroxyl value (measured according to Japanese Industrial Standard (JIS) K-0070-1992) and an acid value (measured according to JIS K-0070-1992) that are each at least 10 mg KOH/g, and more preferably at least 20 mg KOH/g. Anionic strength may be imparted on the toner cores by adding an anionic compound (for example, compound having an ester group, a hydroxyl group, an ether group, an acid group, or a methyl group) to the toner cores. By contrast, cationic strength may be imparted on the toner cores by adding a cationic compound (for example, compound having an amino group or an amide group (more specifically amine or the like) to the toner cores.

The binder resin preferably has one or more functional groups selected from the group consisting of ester groups, hydroxyl groups, ether groups, acid groups (more specifically a carboxyl group or the like), and methyl groups. A hydroxyl group and/or a carboxyl group is/are more preferable. A binder resin having a functional group such as described above tends to react with a shell material to form chemical bonds. Such chemical binding causes strong binding between the toner cores and the shell layers. The binder resin preferably has in molecules thereof a functional group containing an active hydrogen.

The toner cores preferably have charge polarity reverse to that of the shell layers in order to improve adhesion between the toner cores and the shell layers. A configuration having the reverse polarities to each other is for example such that the toner cores are anionic and the shell layers (more specifically, the first or second shell particles) are anionic. For example, anionic strength can be imparted on the toner cores by introducing an anionic functional group such as described above or mixing an anionic compound such as described above. Zeta potential can be used as an index indicative of anionic and cationic strength. For example, in a situation in which the zeta potential of particles (more specifically, toner cores or the like) measured in an aqueous medium adjusted to pH 4 is less than 0 mV at a temperature of 25° C., the particles is anionic. By contrast, for example, in a situation in which the zeta potential of particles (more specifically, the first shell particles or the like) measured in an aqueous medium adjusted to pH 4 is greater than 0 mV (preferably at least +5 mV) at a temperature of 25° C., the particles is cationic. In the present embodiment, a pH of 4 is equivalent to the pH of a toner core dispersion (aqueous medium) during shell layer formation. The zeta potential can be favorably measured by electrophoresis, ultrasound, or electrokinetic sonic amplitude (ESA), for example.

The binder resin preferably has a glass transition point (Tg) of at least 25° C. and no greater than 45° C. (more preferably, at least 30° C. and no greater than 40° C.) and a softening point (Tm) of at least 70° C. and no greater than 100° C. in order to improve both low-temperature fixability and high-temperature preservability of the toner. The respective measuring methods of Tg and Tm may be the same as respective methods described later in Examples or alternative methods thereof.

The toner cores preferably have a volume median diameter ($D_{50}$) of at least 5 μm and no greater than 8 μm. In a configuration in which the toner cores have a volume median diameter of at least 5 μm and no greater than 8 μm, both low-temperature fixability and high-temperature preservability of the toner can be improved. The volume median diameter ($D_{50}$) can be measured using Coulter Counter Multisizer 3 produced by Beckman Coulter, Inc.

Preferably, the binder resin is a thermoplastic resin. Preferable examples of thermoplastic resins that can be used include styrene-based resins, acrylic acid-based resins, olefin-based resins (specific examples include a polyethylene resin and a polypropylene resin), vinyl resins (specific examples include a vinyl chloride resin, a polyvinyl alcohol resin, a vinyl ether resin, and an N-vinyl resin), polyester resins, polyamide resins, urethane resins, styrene-acrylic acid-based resins, and styrene-butadiene-based resins. Among the thermoplastic resins listed above, a polyester resin is excellent in terms of dispersibility of a colorant in the toner cores, chargeability of the toner, and fixability of the toner to a recording medium.

Hereinafter, a polyester resin that can be used as the binder resin will be described. The polyester resin can be synthesized through condensation polymerization or condensation copolymerization of a di-, tri-, or higher-hydric alcohol with a di-, tri-, or higher-basic carboxylic acid.

Examples of di-hydric alcohols that can be used for preparing the polyester resin include diols and bisphenols.

Preferable examples of diols include ethylene glycol, diethylene glycol, triethylene glycol, propylene glycol, 1,3-propanediol, 1,4-butanediol, neopentyl glycol, 1,4-butenediol, 1,5-pentanediol, 1,6-hexanediol, 1,4-cyclohexanedimethanoll, dipropylene glycol, polyethylene glycol, polypropylene glycol, and polypropylene glycol.

Preferable examples of bisphenols include bisphenol A, hydrogenated bisphenol A, polyoxyethylene bisphenol A, and polyoxypropylene bisphenol A.

Preferable examples of tri- or higher-hydric alcohols that can be used for preparing the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Preferable examples of di-basic carboxylic acids that can be used for preparing the polyester resin include maleic acids, fumaric acid, citraconic acids, itaconic acids, glutaconic acids, phthalic acids, isophthalic acids, terephthalic acids, cyclohexanedicarboxylic acids, adipic acids, sebacic acids, azelaic acids, malonic acids, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Preferable examples of tri- or higher-basic carboxylic acids that can be used for preparing the polyester resin include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra (methylenecarboxyl)methane, 1,2,7,8-octanetetracarboxylic acid, pyromellitic acid, and EMPOL trimer acid.

An ester-forming derivative (for example, acid halide, acid anhydride, or lower alkyl ester) of any of the di-, tri-, or higher-basic carboxylic acids listed above may be used. The term "lower alkyl" herein refers to an alkyl group having a carbon number of 1 to 6.

The acid value and the hydroxyl value of the polyester resin can be adjusted through appropriate adjustment of the respective amounts of the alcohol and the carboxylic acid used during preparation of the polyester resin. Increasing the molecular weight of the polyester resin can decrease the acid value and the hydroxyl value of the polyester resin.

In a configuration in which the binder resin is a polyester resin, the polyester resin preferably has a number average molecular weight (Mn) of at least 1,000 and no greater than 2,000 in order to improve both strength of the toner cores and fixability of the toner. The polyester resin preferably has a molecular weight distribution (i.e., a ratio Mw/Mn of mass average molecular weight (Mw) relative to number average molecular weight (Mn)) of at least 9 and no greater than 21. Mn and Mw of the polyester resin can be measured by gel permeation chromatography.

(Colorant)

The toner cores may optionally contain a colorant. The colorant can be a known pigment or dye that matches the color of the toner. The amount of the colorant is preferably at least 1 part by mass and no greater than 20 parts by mass relative to 100 parts by mass of the binder resin, and more preferably at least 3 parts by mass and no greater than 10 parts by mass.

The toner cores may contain a black colorant. Carbon black can for example be used as a black colorant. Alternatively, a colorant whose color is adjusted to black by using colorants such as a yellow colorant, a magenta colorant, and a cyan colorant described later may be used as the black colorant.

The toner cores may contain a non-black colorant such as a yellow colorant, a magenta colorant, or a cyan colorant.

Examples of the yellow colorant include condensed azo compounds, isoindolinone compounds, anthraquinone compounds, azo metal complexes, methine compounds, and arylamide compounds. Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant include C.I. pigment red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

Examples of the cyan colorant include copper phthalocyanine compounds, anthraquinone compounds, and basic dye lake compounds. Specific examples of the cyan colorant include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner cores may optimally contain a releasing agent. The releasing agent is for example used in order to improve fixability of the toner or resistance of the toner to being offset. It is preferable to produce the toner cores using an anionic wax in order to increase the anionic strength of the toner cores. The amount of the releasing agent is preferably at least 1 part by mass and no greater than 30 parts by mass relative to 100 parts by mass of the binder resin, and more preferably at least 5 parts by mass and no greater than 20 parts by mass in order to improve fixability or offset resistance of the toner.

Preferable examples of the releasing agent include: aliphatic hydrocarbon waxes such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon waxes such as polyethylene oxide wax and block copolymer of polyethylene oxide wax; plant waxes such as candelilla wax, carnauba wax, Japan wax, jojoba wax, and rice wax; animal waxes such as beeswax, lanolin, and spermaceti; mineral waxes such as ozokerite, ceresin, and petrolatum; waxes having a fatty acid ester as a major component such as montanic acid ester wax and castor wax; and waxes in which a part or all of a fatty acid ester has been deoxidized such as deoxidized carnauba wax.

A compatibilizer may be added to the toner cores in order to improve compatibility between the binder resin and the releasing agent.

(Charge Control Agent)

The toner cores may optionally contain a charge control agent. The charge control agent is for example used in order to improve charge stability or a charge rise characteristic of the toner. The charge rise characteristic of the toner is an indicator as to whether the toner can be charged to a specific charge level in a short period of time. The anionic strength of the toner cores can be increased through the toner cores containing a negatively chargeable charge control agent.

(Magnetic Powder)

The toner cores may optionally contain a magnetic powder. Examples of the magnetic powder include iron (specific examples include ferrite and magnetite), ferromagnetic metals (specific example include cobalt and nickel), compounds containing either or both of iron and a ferromagnetic metal (specifically, an alloy or the like), ferromagnetic alloys subjected to ferromagnetization (specifically, thermal treatment or the like), and chromium dioxide.

The magnetic powder is preferably subjected to surface treatment in order to inhibit elution of metal ions (for example, iron ions) from the magnetic powder. In a situation in which metal ions are attached to the surfaces of the toner cores, the toner cores tend to adhere to one another in formation of shell layers on the surfaces of the toner cores under an acidic condition. Inhibiting elution of metal ions from the magnetic powder can inhibit the toner cores from adhering to one another.

[Shell Layer]

As already described above, the shell layers each include the first shell particles and the second shell particles. The first and second shell particles will be described below.

<First Shell Particles>

The first shell particles each contain a resin. Examples of resins that can be used include acrylic acid-based resins, styrene-acrylic acid-based resins, silicone-acrylic acid-based graft copolymers, urethane resins, polyester resins, vinyl resins, epoxy resins, and ethylene vinyl alcohol copolymers. The resin contained in the first shell particles is preferably an acrylic acid-based resin, a styrene-acrylic acid-based resin, or a silicone-acrylic acid-based graft copolymer, and more preferably a styrene-acrylic acid-based resin. The styrene-acrylic acid-based resin will be described below.

The styrene-acrylic acid-based resin is a copolymer of a styrene-based monomer and an acrylic acid-based monomer. Preferable examples of styrene-based monomers and acrylic acid-based monomers for synthesis of a styrene-acrylic acid-based resin are indicated below. A carboxyl group can be introduced into a styrene-acrylic acid-based resin through the use of an acrylic acid-based monomer. Further, a hydroxyl group can be introduced into a styrene-acrylic acid-based resin through the use of a monomer having a hydroxyl group (specific examples include p-hydroxystyrene, m-hydroxystyrene, or hydroxyalkyl (meth)acrylate). The acid value of a resultant styrene-acrylic acid-based resin can be adjusted through appropriate adjustment of the amount of the acrylic acid-based monomer. The hydroxyl value of a styrene-acrylic acid-based resin can be adjusted through appropriate adjustment of the amount of the monomer having a hydroxyl value.

Preferable examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethyl styrene.

Preferable examples of the acrylic acid-based monomer include (meth)acrylic acid, alkyl (meth)acrylates, and hydroxyalkyl (meth)acrylates. Preferable examples of alkyl (meth)acrylates include (meth)methyl acrylate, (meth)ethyl acrylate, (meth)n-propyl acrylate, (meth)iso-propyl acrylate, (meth)n-butyl acrylate, (meth)iso-butyl acrylate, and (meth) 2-ethylhexyl acrylate. Preferable examples of hydroxyalkyl (meth)acrylates include 2-hydroxyethyl (meth)acrylate, 3-hydroxypropyl (meth)acrylate, 2-hydroxypropyl (meth) acrylate, and 4-hydroxybutyl (meth)acrylate.

In a configuration in which the toner cores are anionic, the first shell particles is preferably cationic.

In a configuration in which the first shell particles has a number average particle diameter of at least 30 nm and no greater than 90 nm, it is preferable in order to improve charge stability of the toner that the first shell particles has a glass transition point (Tg) of at least 60° C. and no greater than 120° C. and a softening point (Tm) of at least 120° C. and no greater than 210° C. Respective measuring methods of Tg and Tm may be the same as methods described later in Examples or alternative methods thereof.

The content of the first shell particles is preferably at least 1 part by mass and no greater than 3 parts by mass relative to 100 parts by mass of the toner cores. In a configuration in which the content of the first shell particles falls in the above value range, equation (1) tends to be satisfied.

<Second Shell Particles>

The second shell particles each contain a resin. Examples of resins that can be used include acrylic acid-based resins, styrene-acrylic acid-based resins, silicone-acrylic acid-based graft copolymers, urethane resins, polyester resins, vinyl resins, epoxy resins, ethylene-vinyl alcohol copolymers, and the above listed resins into which a cross-linking structure is introduced. Preferable examples of the resins that can be contained in the second shell particles include crosslinked acrylic acid-based resins, crosslinked styrene-acrylic acid-based resins, and crosslinked silicone-acrylic acid-based graft copolymers. A crosslinked styrene-acrylic acid-based resin is more preferable. The styrene-acrylic acid-based resin herein is the same as the styrene-acrylic acid-based resin contained in the first shell particles.

A crosslinking agent for introducing a cross-linking structure into the resin may be a crosslinkble monomer, for example. Examples of the crosslinkable monomer include divinylbenzene-based crosslinkable monomers, diallyl phthalate-based crosslinkable monomers, and dimethacrylic acid ester-based crosslinkable monomers. Examples of divinylbenzene-based crosslinkable monomers include o-divinylbenzene, m-divinylbenzene, and p-divinylbenzene. Examples of diallyl phthalate-based crosslinkable monomers include diallyl isophthalate and diallyl ortho phthalate. Examples of dimethacrylic acid ester-based crosslinkable monomers include ethylene glycol dimethacrylate and triethylene glycol dimethacrylate.

The content of the second shell particles is preferably at least 0.5 parts by mass and no greater than 3 parts by mass relative to 100 parts by mass of the toner cores. In a configuration in which the content of the second shell particles falls in the above value range, equation (2) tends to be satisfied.

[External Additive]

The toner particles may each optionally contain an external additive. Examples of external additives that may be contained in the toner particles include silica particles and particles of metal oxides (specific examples include alumina, titanium oxide, magnesium oxide, zinc oxide, strontium titanate, and barium titanate). For example, the external additive may be subjected to surface modification (specifically, hydrophobization, positive charging, or the like) using a coupling agent.

The external additive preferably has a number average particle diameter of at least 0.01 μm and no greater than 1.0 μm. The amount of the external additive is preferably at least 0.5 parts by mass and no greater than 10 parts by mass relative to 100 parts by mass of the toner mother particles, and more preferably at least 1 part by mass and no greater than 5 parts by mass.

A two-component developer can be prepared by mixing the toner according to the present embodiment with an appropriate carrier. In a situation in which the two-component developer is produced, preferably a magnetic carrier is used.

Preferable examples of the carrier include a carrier whose particles have resin-coated carrier cores. Specific examples of the carrier cores include particles of iron, oxidized iron, reduced iron, magnetite, copper, silicon steel, ferrite, nickel, or cobalt; particles of alloys of any of the above listed materials and a metal such as manganese, zinc, or aluminum; particles of iron-nickel alloy or iron-cobalt alloy; particles of ceramics (specific examples include titanium oxide, aluminum oxide, copper oxide, magnesium oxide, lead oxide, zirconium oxide, silicon carbide, magnesium titanate, barium titanate, lithium titanate, lead titanate, lead zirconate, or lithium niobate); and particles of high-dielectric substances (specific examples include ammonium dihydrogen phosphate, potassium dihydrogen phosphate, or Rochelle salt). A resin carrier may be prepared by dispersing any of the above listed particles in a resin.

Examples of the resin that can be used for coating the carrier cores include acrylic acid-based copolymers, styrene-based copolymers, styrene-acrylic acid-based copolymers, olefin-based copolymers (specific examples include polyethylene, chlorinated polyethylene, and polypropylene), vinyl chloride, polyvinyl acetates, polycarbonate resins, cellulose resins, polyester resins, unsaturated polyester resins, polyamide resins, urethane resins, epoxy resins, silicone resins, fluororesins (specific examples include polytetrafluoroethylene, polychlorotrifluoroethylene, and polyvinylidene fluoride), phenolic resins, xylene resins, diallyl phthalate resins, polyacetal resin, and amino resins. Two or more of the resins listed above may be used in a combination.

The carrier preferably has a number average particle diameter of at least 20 μm and no greater than 120 μm, and more preferably at least 25 μm and no greater than 80 μm as measured through an electron microscope.

In a situation in which the toner and the carrier are used for preparing a two-component developer, the toner preferably constitutes at least 3% by mass and no greater than 20% by mass relative to the mass of the two-component developer, and more preferably at least 5% by mass and no greater than 15% by mass.

[Toner Production Method]

The following describes a method for producing the toner according to the present embodiment. The method for producing the toner involves for example producing the toner cores and forming the shell layers. The method may involve drying, washing, and external addition as appropriate depending on necessity thereof. In forming the shell layers, the shell layers are formed on the surfaces of the toner cores.

(Toner Cores Preparation)

For producing the toner cores, a pulverization method or a aggregation method is preferable, for example.

In the pulverization method, a binder resin and an internal additive (for example, a colorant, a releasing agent, a charge control agent, or a magnetic powder) are mixed together. The resultant mixture is then melt and kneaded. Subsequently, the resultant kneaded substance is pulverized. The resultant pulverized substance is classified then. Through the above, toner cores having a desired particle diameter can be prepared. The toner cores can be prepared relatively easily by the pulverization method. The toner cores are preferably produced by the pulverization method.

The aggregation method involves aggregation and coalescence, for example. In aggregation, plural types of particles of respective components constituting the toner cores are caused to aggregate in an aqueous medium to form plural types of aggregated particles containing the respective toner core components. In coalescence, the respective components contained in the aggregated particles are caused to coalesce in an aqueous medium to yield toner cores. Toner cores having uniform shape and size can be easily yield by the aggregation method.

(Shell Layer Formation)

In shell layer formation, shell layers are formed on the surfaces of the toner cores. Shell layer formation involves attaching the first shell particles on the surfaces of the toner cores and attaching the second shell particles on the surfaces of the toner cores to which the first shell particles have been attached (also referred below to covered toner cores).

<Attachment of First Shell Particles to Surfaces of Toner Cores>

The first shell particles are attached to the surfaces of the toner cores so that equation (1) is satisfied. Examples of the method for attaching the first shell particles include methods using a fluid bed, spray drying methods, drying methods (specifically, a mechanochmical method and the like), granulation and pulverization methods, and aggregation methods.

An example method that uses fluid bed involves for example insufflating a liquid in which the first shell particles are dispersed onto the toner cores in a fluidized bed state. Then, the toner cores are dried to secure the first shell particles to the surfaces of the toner cores. The method using a fluid bed uses a particle coater (GPCG-5 (SPC) produced by Powrex Corporation), for example.

An example spray dry method involves for example spraying a liquid in which the first shell particles are dispersed onto the surfaces of the toner cores. After spraying, the toner cores are dried to secure the first shell particles to the surfaces of the toner cores. The spray dry method may use for example a particle surface modifier (Coatmizer (registered Japanese trademark) produced by Freund Corporation).

An example dry method involves dry-mixing the toner cores and the first shell particles. The toner cores and the first shell particles are bonded together through the above mixing to secure the first shell particles to the surfaces of the first toner cores. Among drying methods, a mechanochemical method is particularly preferable in which the toner cores and the first shell particles are mechanochemically bonded together through application of mechanical and thermal energy. A mechanochemical method employed in a first process in shell layer formation described later may be the same as or different from a mechanochemical method employed in a second process in shell layer formation described later.

In an example granulation and pulverization method, while the toner cores are stirred, a first shell particle dispersion is added to the toner cores flowing by being stirred. The above causes aggregation of the toner cores in the first shell particle dispersion to form aggregated particles of the toner cores. This yields in a mixture (the toner cores and the first shell particles) in a capillary state. Subsequently, the resultant mixture in the capillary state is heated while being stirred, thereby pulverizing the mixture and securing the first shell particles to the surfaces of the toner cores.

In an example aggregation method, the first shell particles and the toner cores are dispersed in a liquid for attaching the first shell particles to the surfaces of the toner cores. Thereafter, the liquid is heated while being stirred, so that the first shell particles are secured to the surfaces of the toner cores. The first shell particles are attached to the surfaces of the toner cores preferably by the aggregation method in terms of easy fulfillment of equation (1).

The following is a detailed description of an example aggregation method. First, the toner cores prepared through the above preparation of the toner cores are dispersed in an aqueous medium to prepare a toner core dispersion. In order to improve dispersibility of the toner cores, a surfactant may be added to the dispersion or the pH of the aqueous medium may be adjusted. Examples of the surfactant include cationic surfactants, anionic surfactant, and nonionic surfactants. A surfactant having the same polarity as that of the toner cores is preferable. In a situation in which anionic toner cores are dispersed, for example, an anionic surfactant is preferably used. The aqueous medium is a medium containing water (more specifically, purified water, a mixed liquid of water and a polar medium, or the like) as a major component. The aqueous medium may function as a solvent. A solute may be dissolved in the aqueous medium. The aqueous medium may function as a dispersion medium. A dispersoid may be dispersed in the aqueous medium. An alcohol (more specifically, methanol, ethanol, or the like) may be used as the polar medium in the aqueous medium. The aqueous medium is preferably water in terms of inhibiting dissolution of the binder resin or elution of a releasing agent. An example method for achieving good dispersion of the toner cores in the aqueous medium involves mechanically dispersing the toner cores using an apparatus capable of vigorously stirring the dispersion.

Subsequently, the first shell particles are added to the toner core dispersion and the toner core dispersion is raised to a specific temperature while being stirred. Then, the toner core dispersion is kept at the temperature for a specific time period. As a result, the first shell particles are attached to the surfaces of the toner cores. Through the above, a dispersion of the toner cores each covered with the first shell particles is prepared.

The toner core dispersion to which the first shell particles are added is preferably adjusted to have a pH of about 4 using an acid substance.

The temperature in attachment of the first shell particles to the surfaces of the toner cores is preferably at least 40° C. and no greater than 95° C., and more preferably at least 50° C. and no greater than 80° C. in order to favorably attach the first shell particles to the surfaces of the toner cores.

Effect of hetero-aggregation can be utilized to favorably attach the first shell particles to the surfaces of the toner cores. For example, the charge polarity of the toner cores is preferably reverse to that of the first shell particles. A situation of polarities reverse to each other may be a combination of for example anionic toner cores and cationic first shell particles. In the above situation, electrostatic attraction acts between the toner cores and the first shell particles such that the first shell particles tend to be attached to the surfaces of the toner cores.

An electrolyte may be added to a mixed liquid of the toner core dispersion and the first shell particles in attachment of the first shell particles to the surfaces of the toner cores in order to favorably attach the first shell particles to the surfaces of the toner cores. Examples of the electrolyte include inorganic salts (specific examples includes magnesium chloride, sodium chloride, magnesium sulfate, and aluminum chloride).

(Washing)

The toner production method may involve, as needed, washing the covered toner cores using a wash fluid to collect the covered toner cores from the dispersion of the covered toner cores after the first shell particles are attached to the surfaces of the toner cores. After the first shell particles are attached to the surfaces of the toner cores as described above, the dispersion containing the covered toner cores is cooled to normal temperature (for example 25° C.). Then, the covered toner cores are washed using a wash fluid. The wash fluid may be the above aqueous medium, for example.

(Drying)

The toner production method may involve, as needed, drying the covered toner cores that have been washed to collect the covered toner cores from the dispersion of the covered toner cores. Drying is to dry the covered toner cores. Preferable examples of methods for drying the covered toner cores include methods using a dryer (for example, a spray dryer, a fluidized bed dryer, a vacuum freeze dryer, or a reduced pressure dryer). In particular, the spray dryer is preferably used in order to inhibit aggregation of the covered toner particles during drying.

<Attachment of Second Shell Particles to Surfaces of Toner Cores to Which First Shell Particles Have Been Attached>

In attachment of the second shell particles to the surfaces of the covered toner cores, the covered toner cores and the second shell particles are dry-mixed so that equation (2) is satisfied. The second shell particles are secured to the covered toner cores for example by a mechanochemical method in attachment of the second shell particles to the surfaces of the covered toner cores. No specific limitation is placed on structure and principle of an apparatus used in the mechanochemical method, and an apparatus can be used for example that is capable of simultaneously applying plural types of stresses such as shear, compression, or collision. Examples of an apparatus that adopts the mechanochemical method include ball-type kneaders (specifically, a rotary ball mill and the like), wheel type kneaders (specifically, an edge runner and the like), a surface modifier (Nara Hybridization System NHS-1 produced by Nara Machinery Co., Ltd.), dry particle composing apparatuses (Nobilta (registered Japanese trademark) NOB-130 and circulation type Mechanofusion System (registered Japanese trademark) AMS produced by Hosokawa Micron Corporation), and an FM mixer (a product of Nippon Coke & Engineering Co., Ltd.).

(External Addition)

Next, an external additive is attached to the surfaces of the toner mother particles. Preferable examples of the method for attaching the external additive to the toner mother particles include a method involving mixing the external additive with the toner mother particles using a mixer (for example, an FM mixer or a Nauta mixer (registered Japanese trademark)) under conditions set such that the external additive does not become embedded in the surfaces of the toner particles.

Note that the above toner producing method may be altered in any way depending on required toner configuration, characteristics, etc. For example, the toner cores may be dispersed in the aqueous medium after dispersion of the first shell particles in the aqueous medium in the first process. Alternatively, the first shell particles may be added to the aqueous medium in which the toner cores has been dispersed. Furthermore, any of the above various processes may be omitted depending on usage of the toner. In a situation in which no external additive adheres to the surfaces of the shell layers (omission of external addition), the toner mother particles and toner particles are equivalent. Preferably, a large number of the toner particles are formed at the same time in order to produce the toner efficiently.

EXAMPLES

The following explains examples of the present disclosure. Tables 1 and 2 indicate toners of Examples 1-30 and Comparative Examples 1-17 (each are an electrostatic latent image developing toner), respectively. Note that the respective contents of the first and second shell particles are expressed in terms of mass relative to 100 parts by mass of the toner cores.

TABLE 1

| | First shell particles | | | Second shell particles | | |
|---|---|---|---|---|---|---|
| | First shell particle suspension | Mass [%] | Coverage ($C_F$) [%] | Second shell particle suspension | Mass [%] | Coverage ($C_S$) [%] |
| Example 1 | B-3 | 1.0 | 34.1 | C-1 | 1.0 | 17.0 |
| Example 2 | B-2 | 1.0 | 50.0 | C-1 | 1.0 | 17.0 |
| Example 3 | B-1 | 1.0 | 30.3 | C-1 | 1.0 | 17.0 |
| Example 4 | B-4 | 1.0 | 25.1 | C-1 | 1.0 | 17.0 |
| Example 5 | B-4 | 2.0 | 45.4 | C-1 | 1.0 | 17.0 |
| Example 6 | B-5 | 3.0 | 33.2 | C-1 | 1.0 | 17.0 |
| Example 7 | B-1 | 1.0 | 49.8 | C-1 | 1.0 | 17.0 |
| Example 8 | B-1 | 1.0 | 30.3 | C-1 | 0.5 | 8.5 |
| Example 9 | B-1 | 1.0 | 30.3 | C-3 | 1.0 | 22.7 |
| Example 10 | B-1 | 1.0 | 30.3 | C-2 | 1.0 | 27.3 |
| Example 11 | B-1 | 1.0 | 30.3 | C-4 | 0.5 | 6.8 |
| Example 12 | B-1 | 1.0 | 30.3 | C-4 | 1.0 | 13.6 |
| Example 13 | B-1 | 1.0 | 30.3 | C-4 | 2.0 | 27.2 |
| Example 14 | B-1 | 1.0 | 30.3 | C-5 | 1.0 | 9.1 |
| Example 15 | B-1 | 1.0 | 30.3 | C-5 | 2.0 | 18.2 |
| Example 16 | B-1 | 1.0 | 30.3 | C-5 | 3.0 | 27.3 |
| Example 17 | B-1 | 1.0 | 30.3 | C-6 | 1.0 | 6.8 |
| Example 18 | B-1 | 1.0 | 30.3 | C-6 | 2.0 | 13.6 |
| Example 19 | B-1 | 1.0 | 30.3 | C-6 | 3.0 | 20.4 |
| Example 20 | B-1 | 1.0 | 30.3 | C-7 | 1.0 | 5.5 |
| Example 21 | B-1 | 1.0 | 30.3 | C-7 | 2.0 | 11.0 |
| Example 22 | B-1 | 1.0 | 30.3 | C-7 | 3.0 | 16.5 |
| Example 23 | B-1 | 1.0 | 30.3 | C-8 | 2.0 | 9.8 |
| Example 24 | B-1 | 1.0 | 30.3 | C-8 | 3.0 | 14.7 |
| Example 25 | B-1 | 1.0 | 30.3 | C-9 | 0.5 | 6.8 |
| Example 26 | B-1 | 1.0 | 30.3 | C-9 | 1.0 | 13.6 |
| Example 27 | B-1 | 1.0 | 30.3 | C-9 | 2.0 | 27.2 |
| Example 28 | B-1 | 1.0 | 30.3 | C-10 | 1.0 | 9.1 |
| Example 29 | B-1 | 1.0 | 30.3 | C-10 | 2.0 | 18.2 |
| Example 30 | B-1 | 1.0 | 30.3 | C-10 | 3.0 | 27.3 |

TABLE 2

| | First shell particles | | | Second shell particles | | |
|---|---|---|---|---|---|---|
| | First shell particle suspension | Mass [%] | Coverage ($C_F$) [%] | Second shell particle suspension | Mass [%] | Coverage ($C_S$) [%] |
| Comparative Example 1 | B-5 | 1.0 | 16.6 | C-1 | 1.0 | 17.0 |
| Comparative Example 2 | B-6 | 1.0 | 15.2 | C-1 | 1.0 | 17.0 |
| Comparative Example 3 | B-7 | 1.0 | 13.6 | C-1 | 1.0 | 17.0 |
| Comparative Example 4 | B-1 | 2.0 | 60.6 | C-1 | 1.0 | 17.0 |
| Comparative Example 5 | B-1 | 3.0 | 90.9 | C-1 | 1.0 | 17.0 |
| Comparative Example 6 | B-4 | 3.0 | 68.1 | C-1 | 1.0 | 17.0 |
| Comparative Example 7 | B-1 | 1.0 | 30.3 | C-1 | 2.0 | 34.0 |
| Comparative Example 8 | B-1 | 1.0 | 30.3 | C-3 | 2.0 | 45.4 |
| Comparative Example 9 | B-1 | 1.0 | 30.3 | C-2 | 2.0 | 54.6 |
| Comparative Example 10 | B-1 | 1.0 | 30.3 | C-4 | 3.0 | 40.8 |

TABLE 2-continued

| | First shell particles | | | Second shell particles | | |
|---|---|---|---|---|---|---|
| | First shell particle suspension | Mass [%] | Coverage ($C_F$) [%] | Second shell particle suspension | Mass [%] | Coverage ($C_S$) [%] |
| Comparative Example 11 | B-1 | 1.0 | 30.3 | C-5 | 0.5 | 4.6 |
| Comparative Example 12 | B-1 | 1.0 | 30.3 | C-6 | 0.5 | 3.4 |
| Comparative Example 13 | B-1 | 1.0 | 30.3 | C-7 | 0.5 | 2.8 |
| Comparative Example 14 | B-1 | 1.0 | 30.3 | C-8 | 0.5 | 2.5 |
| Comparative Example 15 | B-1 | 1.0 | 30.3 | C-8 | 1.0 | 4.9 |
| Comparative Example 16 | B-1 | 1.0 | 30.3 | C-9 | 3.0 | 40.8 |
| Comparative Example 17 | B-1 | 1.0 | 30.3 | C-10 | 0.5 | 4.6 |

(Preparation of First Shell Particle Suspension B-1)

A four-necked flask was used as a reaction vessel. The four-necked flask was a 1-L reaction vessel equipped with a thermometer, a stirring impeller, and a reflux cooler and having an opening from which a monomer is allowed to drip. The reaction vessel was set in a water bath, and 360 parts by mass of ion exchanged water for emulsification and 2.0 parts by mass of a reactive emulsifier (ADEKA REASOAP (registered Japanese trademark) SR-1025 produced by ADEKA CORPORATION, component: ether sulfate type ammonium salt, concentration: 25% by mass, solvent: water) were added into the reaction vessel. Subsequently, the contents of the reaction vessel were increased in temperature up to 80° C. using the water bath. Note that the ion exchanged water for emulsification was ion exchanged water deoxidized by nitrogen bubbling in advance.

Next, 30 parts by mass of styrene, 50 parts by mass of n-butyl acrylate, 20 parts by mass of 2-hydroxyethyl methacrylate, 3.2 parts by mass of a reactive emulsifier (ADEKA REASOAP (registered Japanese trademark) SR-1025 produced by ADEKA CORPORATION, component: ether sulfate type ammonium salt, concentration: 25% by mass, solvent: water), and 40 parts by mass of ion exchanged water for emulsification were added to the reaction vessel and the contents of the reaction vessel were emulsified using a high-speed shear emulsification device (CLEARMIX (registered Japanese trademark) produced by M Technique Co., Ltd.) under conditions of a rotational speed of 10,000 rpm and a treatment time period of five minutes. Through the above, a monomer suspension was prepared.

To a reaction vessel, 0.2 parts by mass of ammonium persulfate was added. Subsequently, 28.6 parts by mass (20% by mass of total amount of use) of the monomer suspension was added into the reaction vessel and emulsion polymerization was caused for 30 minutes. After the emulsion polymerization, the monomer suspension was allowed to drip by 114.5 parts by mass (remainder: 80% by mass) over three hours. After the dripping, emulsification polymerization was continued for additional one hour. Then, 5.9 parts by mass of ion exchanged water for dilution was added to the reaction vessel and the contents of the reaction vessel were cooled to 40° C. to prepare a suspension. Ion exchanged water was further added to the reaction vessel to adjust the solid concentration and pH of the vessel contents to prepare a first shell particle suspension B-1. The prepared suspension B-1 had a solid concentration of 10% by mass and a pH of 2.6 at a temperature of 25° C. The first shell particles in the suspension B-1 had a number average particle diameter of 45 nm, an SP value of 10.0, a Tg of 77° C., and a Tm of 164° C. The first shell particle suspension B-1 was excellent in storage stability.

(Preparation of First Shell Particle Suspensions B-1 to B-7)

The first shell particle suspensions B-2 to B-7 were prepared according to the same method as for the first shell particle suspension B-1 in all aspects other than that 2.0 parts by mass of the reactive emulsifier in the second addition and 360 parts by mass of ion exchanged water in the first addition were changed to those listed in Table 3. The first shell particles in the suspensions B-2 to B-7 had an SP value of 10.0. Tg and Tm of the first shell particles in the respective suspensions B-2 to B-7 are listed in Table 3.

zene, 3 parts by mass of an anionic surfactant (Emal 0 (sodium lauryl sulfate) produced by Kao Corporation), and 40 parts by mass of ion exchanged water for emulsification were added into the reaction vessel and the contents of the reaction vessel were emulsified using a high-speed shear emulsification device (CLEARMIX (registered Japanese trademark) CLM-2.2S produced by M Technique Co., Ltd.) under conditions of a rotational speed of 10,000 rpm and a processing time period of five minutes. Through the above, a monomer suspension was prepared.

Subsequently, 1.0 part by mass of ammonium persulfate was added into a reaction vessel. Furthermore, 100 parts by mass of the monomer suspension was allowed to drip into the reaction vessel over three hours for emulsion polymerization. After the dripping was complete, emulsion polymerization was continued for additional one hour to prepare a

TABLE 3

| First shell particle suspension | Styrene [part] | n-butyl acrylate [part] | Ammonium persulfate [part] | Emulsifier [part] 1st addition | Emulsifier [part] 2nd addition | Water [part] 1st addition | Water [part] 2nd addition | Rotational speed [rpm] | First shell particles: Number average particle diameter [nm] | First shell particles: Tg [° C.] | First shell particles: Tm [° C.] |
|---|---|---|---|---|---|---|---|---|---|---|---|
| B-1 | 30 | 50 | 20 | 0.2 | 2.0 | 360 | 40 | 10000 | 45 | 77 | 164 |
| B-2 | 30 | 50 | 20 | 0.2 | 4.8 | 560 | 40 | 10000 | 20 | 72 | 158 |
| B-3 | 30 | 50 | 20 | 0.2 | 2.8 | 400 | 40 | 10000 | 40 | 75 | 160 |
| B-4 | 30 | 50 | 20 | 0.2 | 1.6 | 300 | 40 | 10000 | 60 | 79 | 170 |
| B-5 | 30 | 50 | 20 | 0.2 | 1.2 | 300 | 40 | 10000 | 82 | 82 | 175 |
| B-6 | 30 | 50 | 20 | 0.2 | 1.0 | 300 | 40 | 10000 | 90 | 85 | 177 |
| B-7 | 30 | 50 | 20 | 0.2 | 0.8 | 300 | 40 | 10000 | 100 | 88 | 183 |

(Preparation of Second Shell Particle Suspension C-1)

A four-necked flask was used as a reaction vessel. The four-necked flask was a 1-L reaction vessel equipped with a thermometer, a stirring impeller, and a reflux cooler and having an opening from which a monomer is allowed to drip. The reaction vessel was set in a water bath, and 200 parts by mass of ion exchanged water for emulsification and 1.5 parts by mass of an anionic surfactant (Emal 0 (sodium lauryl sulfate) produced by Kao Corporation) were added into the reaction vessel. The contents of the reaction vessel were then increased in temperature up to 80° C. using the water bath.

Subsequently, 45 parts by mass of methyl methacrylate, 50 parts by mass of styrene, 5 parts by mass of divinylbensecond shell particle suspension C-1. The second shell particles in the suspension C-1 had a number average particle diameter of 80 nm and an SP value of 9.5.

(Preparation of Second Shell Particle Suspensions C-2 to C-8)

Second shell particle suspensions C-2 to C-8 were prepared according to the same method as for the second shell particle suspension C-1 in all aspects other than that the amount of Emal 0 in the first addition was changed from 1.5 parts by mass to those listed in Table 4. The second shell particles in the respective second shell particle suspensions C-2 to C-7 had an SP value of 9.5.

TABLE 4

| Second shell particle suspension | Styrene [part] | Methyl methacrylate [part] | Divinyl-benzene [part] | Ammonium persulfate [part] | Emal 0 [part] 1st addition | Emal 0 [part] 2nd addition | Cetyltrimethylammonium Chloride [part] 1st addition | Cetyltrimethylammonium Chloride [part] 2nd addition | Water [part] 1st addition | Water [part] 2nd addition | Rotational speed [part] | Number average particle diameter of second shell particles [nm] |
|---|---|---|---|---|---|---|---|---|---|---|---|---|
| C-1 | 50 | 30 | 20 | 0.2 | 1.5 | 3.0 | — | — | 200 | 40 | 10000 | 80 |
| C-2 | 50 | 30 | 20 | 0.2 | 4.0 | 3.0 | — | — | 200 | 40 | 10000 | 50 |
| C-3 | 50 | 30 | 20 | 0.2 | 2.5 | 3.0 | — | — | 200 | 40 | 10000 | 60 |
| C-4 | 50 | 30 | 20 | 0.2 | 1.2 | 3.0 | — | — | 200 | 40 | 10000 | 100 |
| C-5 | 50 | 30 | 20 | 0.2 | 1.0 | 3.0 | — | — | 200 | 40 | 10000 | 150 |
| C-6 | 50 | 30 | 20 | 0.2 | 0.8 | 3.0 | — | — | 200 | 40 | 10000 | 200 |
| C-7 | 50 | 30 | 20 | 0.2 | 0.5 | 3.0 | — | — | 200 | 40 | 10000 | 250 |
| C-8 | 50 | 30 | 20 | 0.2 | 0.4 | 3.0 | — | — | 200 | 40 | 10000 | 280 |

TABLE 4-continued

| Second shell particle suspension | Styrene [part] | Methyl methacrylate [part] | Divinyl-benzene [part] | Ammonium persulfate [part] | Emal 0 [part] 1st addition | Emal 0 [part] 2nd addition | Cetyltrimethylammonium Chloride [part] 1st addition | Cetyltrimethylammonium Chloride [part] 2nd addition | Water [part] 1st addition | Water [part] 2nd addition | Rotational speed [part] | Number average particle diameter of second shell particles [nm] |
|---|---|---|---|---|---|---|---|---|---|---|---|---|
| C-9 | 50 | 30 | 20 | 0.2 | — | — | 2.0 | 3.0 | 200 | 40 | 10000 | 100 |
| C-10 | 50 | 30 | 20 | 0.2 | — | — | 1.5 | 3.0 | 200 | 40 | 10000 | 150 |

(Preparation of Second Shell Particle Suspensions C-9 and C-10)

Second shell particle suspensions C-9 and C-10 were prepared according to the same method as for the second shell particle suspension C-1 in all aspects other than that Emal 0 was changed to cetyltrimethylammonium chloride and the respective amounts thereof in the first and second addition were changed from 1.5 parts by mass and 3.0 parts by mass to those listed in Table 4. The second shell particles in the respective second shell particle suspensions C-9 and C-10 had an SP value of 9.5.

Example 1

Production of Toner Cores

An FM mixer (product of Nippon Coke & Engineering Co., Ltd.) was used to mix 100 parts by mass of a binder resin (polyester resin, Tg: 42° C., Tm: 85° C., acid value: 18.5 mgKOH/g), 4 parts by mass of a colorant (C.I. Pigment Blue 15:3, component: copper phthalocyanine), 5 parts by mass of an ester wax (NISSAN ELECTOL (registered Japanese trademark) WEP-3 produced by NOF Corporation), and 1 part by mass of a quaternary ammonium salt (BONTRON (registered Japanese trademark) P-51 produced by ORIENT CHEMICAL INDUSTRIES, Co., Ltd.). The resultant mixture was melt and kneaded using a two-axis extruder (PCM-30 produced by Ikegai Corp.). The resultant kneaded substance was cooled and then roughly pulverized using a pulverizer (Rotoplex (registered Japanese trademark) type 16/8 produced by Hosokawa Micron Corporation). The resultant roughly pulverized substance was finely pulverized using a pulverizer (Turbo Mill produced by Freund-Turbo Corporation). Subsequently, the resultant finely pulverized substance was classified using a classifier (Elbow Jet EJ-LABO produced by Nittetsu Mining Co., Ltd.) to produce toner cores A. The produced toner cores A had a volume median diameter ($D_{50}$) of 6.8 μm, a number average circularity of 0.95, and an SP value of 10.5.

(Processes for Shell Layer Formation)

[First Process]

A three-necked flask was used as a reaction vessel. The three-necked flask is a 1-L reaction vessel equipped with a thermometer and a stirring impeller. The reaction vessel was set in a water bath. Then, 261 parts by mass of ion exchanged water and 29 parts by mass of an anionic surfactant (Emal E27C produced by Kao Corporation) were added into the reaction vessel to prepare an aqueous solution of the anionic surfactant having a concentration of 1% by mass. Subsequently, 100 parts by mass of toner cores were added into the reaction vessel. The internal temperature of the reaction vessel was kept at 35° C. by using the water bath. The contents of the reaction vessel were stirred using a high-speed shear emulsification device (CLEARMIX (registered Japanese trademark) CLM-2.2S produced by M Technique Co., Ltd.) under conditions of a rotational speed of 10,000 rpm and a temperature of 35° C. to prepare a toner core dispersion.

Then, 10 parts by mass of the first shell particle suspension B-3 (solid concentration: 10% by mass) was added into the reaction vessel. Note that the solid mass in the first shell particle suspension B-3 corresponded to 1% by mass of the toner cores. After the first shell particles were attached to the surfaces of the toner cores, hydrochloric acid was allowed to drip into the reaction vessel for pH adjustment of the contents of the reaction vessel to 3.5 in order to stabilize dispersity of the toner cores. The contents of the reaction vessel were then stirred for 30 minutes at a temperature of 35° C. After the stirring, the temperature of the contents of the reaction vessel was raised to 65° C. and kept at 65° C. for 30 minutes while the contents were stirred. Thereafter, the contents of the reaction vessel were quickly cooled to 25° C. to prepare a suspension.

The resultant suspension was solid-liquid separated using a Buchner funnel to collect a solid. The resultant solid was washed using ion exchanged water in a repetitive manner until the electrical conductivity of a filtrate dropped to 3 μS/m or less. After the washing, the solid was dried until the solid has a moisture content of no greater than 0.5% by mass to prepare covered toner cores. The prepared covered toner cores had a volume median diameter ($D_{50}$) of 6.8 μm, a number average circularity of 0.970, and a $C_F$ of 34.1%. Note that the number average circularity was measured using a flow particle imaging instrument (FPIA (registered Japanese trademark)—3000 produced by Sysmex Corporation).

[Second Process]

A dry particle composing machine (Nobilta (registered Japanese trademark) NOB-130 produced by Hosokawa Micron Corporation) was used to conjugate 101 parts by mass of the covered toner cores (toner cores covered with the first shell particles) and 1 part by mass of the second shell particles obtained from the second shell particle suspension C-1 under conditions of a rotational speed of 5000 rpm and a treatment time period of one minute. Through the above, toner mother particles each covered with a shell layer were prepared. The prepared toner mother particles had a roundness of 0.972, a volume median diameter ($D_{50}$) of 6.8 μm, and a $C_S$ of 17.0%.

(External Addition)

An FM mixer (product of Nippon Coke & Engineering Co., Ltd.) was used to mix 100 parts by mass of the toner mother particles and 1.5 parts by mass of dry silica particles (AEROSIL (registered Japanese trademark) REA90 produced by Nippon Aerosil Co., Ltd., positively chargeable silica particles subjected to hydrophobization) for three minutes to attach the silica particles to the toner mother particles. The resultant toner particles were then sifted using a 300 mesh sieve (opening 48 μm) to yield a toner according to Example 1.

Examples 2-30 and Comparative Examples 1-17

Toners according to Examples 2-30 and Comparative Examples 1-17 were produced according to the same method as for the toner according to Example 1 in all aspects other than that the type (B-3) and the mass rate (1.0% by mass) of the first shell particle suspension and the type (C-1) and the mass rate (1.0% by mass) of the second shell particle suspension were changed to those listed in Tables 1 and 2.

[Evaluation Methods]

The following explains methods by which samples (toners according to Examples 1-30 and Comparative Examples 1-17) were measured and evaluated.

(Coverage by First Shell Particles)

The coverage of the covered toner cores by the first shell particles was measured for each sample (toners according to Examples 1-30 and Comparative Examples 1-17). The coverage by the first shell particles were measured as follows. Covered toner cores of the sample (toner) were placed on 2-mL solution of 0.5% mass of ruthenium tetraoxide for five minutes and exposed to a ruthenium vapor atmosphere. Through the above, covered toner cores died with ruthenium were prepared. Subsequently, the dyed covered toner cores were observed at a magnitude of 100,000× using a field effect scanning electron microscope (FE-SEM) (JSM-7600F produced by JEOL Ltd.) and a backscattered electron image of the covered toner cores was taken. The taken backscattered electron image of the covered toner cores was constituted by pixels having a luminance of at least 0 and no greater than 255. The distribution of luminance values (luminance distribution) of the covered toner cores was calculated based on the backscattered electron image of the covered toner cores using an image analysis software (WinROOF produced by Mitani Corporation). The horizontal axis and the vertical axis of the luminance distribution indicate luminance and frequency, respectively.

Respective luminance distributions expressed as a Gaussian function (also referred below to as Gaussian luminance distributions) for the toner cores and the first shell particles were fitted to a luminance distribution of the covered toner cores. The luminance distribution of the toner cores herein is a distribution of luminance values of only the toner cores. The luminance distribution of the first shell particles is a distribution of luminance values of only the first shell particles. Through the fitting, the luminance distribution of the covered toner cores was wave separated to respective the Gaussian luminance distributions of the toner cores and the first shell particles. After the fitting (waveform separation), the respective areas of the toner cores and the first shell particles in the respective Gaussian luminance distributions were calculated. A sum of the areas of the toner cores and the first shell particles in the respective Gaussian luminance distributions was calculated. $C_F$ was obtained from the calculated sum of the areas of the toner cores and the first shell particles in the respective Gaussian luminance distributions using the following equation (6).

$$C_F\ (\%)=[\text{Area of first shell particles in Gaussian luminance distribution/sum of areas of toner cores and first shell particles in Gaussian luminance distributions}]\times 100 \quad (6)$$

(Coverage by Second Shell Particles)

The coverage by the second shell particles was measured for each sample (toners according to Examples 1-30 and Comparative Examples 1-17). The coverage by the second shell particles was obtained by the following manner. A backscattered electron image of the toner particles was taken according to the same method as in the method for measuring the coverage by the first shell particles as described above in all aspect other than a measurement target was changed from the covered toner cores to the toner particles. The luminance distribution of the toner particles was calculated from the taken backscattered electron image of the toner particles using an image analysis software (WinROOF produced by Mitani Corporation).

Respective luminance distributions expressed as a Gaussian function for the toner cores, the first shell particles, and the second shell particles were fitted to a luminance distribution of the toner particles. The luminance distribution of the second shell particles is a distribution of luminance values of only the second shell particles. Through the fitting, the luminance distribution of the toner particles was wave separated to respective Gaussian luminance distributions of the toner cores, the first shell particles, and the second shell particles. After the fitting (waveform separation), the respective areas of the toner cores, the first shell particles, and the second shell particles in the respective Gaussian luminance distributions were calculated. A sum of the areas of the toner cores, the first shell particles, and the second shell particles in the respective Gaussian luminance distributions was calculated. $C_S$ was obtained from the area of the second shell particles in the Gaussian luminance distribution and the calculated sum of the toner cores, the first shell particles, and the second shell particles in the respective Gaussian luminance distributions using the following equation (7).

$$C_S\ (\%)=[\text{Area of second shell particles in Gaussian luminance distribution/sum of areas of toner cores, first shell particles, and second shell particles in Gaussian luminance distributions}]\times 100 \quad (7)$$

(Glass transition point (Tg))

The glass transition point (Tg) of a resin was measured according to the following method. A differential scanning calorimeter (DSC-6220 produced by Seiko Instruments Inc.) was used as a measuring device. A 10-mg sample resin was placed in an aluminum pan. An empty aluminum pan was used as a reference. A heat absorption curve for the sample was plotted under conditions of a measurement temperature range of 25° C. to 200° C. and a heating rate of 10° C./minute in a normal-temperature and normal-humidity environment (temperature: 23° C., relative humidity: 50% RH). In the plotted heat absorption curve, a temperature at an intersection of a chart base line and a tangent of the heat absorption curve around a glass transition point was taken as a glass transition point.

(Softening Point (Tm))

The softening point (Tm) of a resin was measured according to the following method. First, a sample resin was placed in a normal-temperature and normal-humidity environment (temperature: 23° C.±1° C., relative humidity: 50% RH±5% RH) for at least 12 hours to adjust the humidity of the resin. Subsequently, 1.1 parts by mass of the resin of which humidity has been adjusted was pressure-formed at a pressure of 10 MPa using a pressure forming machine for formation of a formed sample having a columnar shape with a diameter of 1 cm. The formed sample was then melt to flow using a capillary rheometer (CFT-500D produced by Shimadzu Corporation) in a normal-temperature and normal-humidity environment (temperature: 23° C.±5° C., relative humidity: 50% RH±10% RH) under specific conditions. The specific conditions herein were as follows: a nozzle with 1 mmϕ×10 mm, a load of 294 N (30 Kgf), a preheating time period of five minutes, and a heating rate of 3° C./min. Through the above, an S-shaped curve of the resin (horizontal axis: temperature, vertical axis: stroke) was plotted. Tm of the resin was read from the plotted S-shaped curve. Specifically, a temperature (° C.) on the plotted S-shaped curve corresponding to a stroke value of $(S_1+S_2)/2$ was taken as Tm of the sample resin, where $S_1$ represents a maximum stroke value and $S_2$ represents a base line stroke value at low temperatures in the plotted S-shaped curve.

(Printing Durability Test)

A resin-covering ferrite carrier produced according to the following method and a sample (toner) were mixed for 30 minutes using a ball mill to prepare a developer for evaluation use having a toner density of 10% by mass.

(Preparation of Carrier)

Appropriate amounts of respective raw materials (specifically, MnO, MgO, $Fe_2O_3$, and SrO) were blended so as to be 39.7 mol % in terms of MnO, 9.9 mol % in terms of MgO, 49.6 mol % in terms of $Fe_2O_3$, and 0.8 mol % in terms of SrO. Water was added thereto. Then, the blended substance was pulverized over 10 hours using a wet ball mill and then mixed. Subsequently, the resultant mixture was dried and maintained at 950° C. for four hours.

Next, the mixture was pulverized over 24 hours using a wet ball mill to prepare a slurry. The prepared slurry was granulated and then dried. Subsequently, the dried granulated substance was kept at 1270° C. in an atmosphere of an oxygen density of 2% for six hours and then broken up. Thereafter, the granularity of the resultant substance was adjusted to prepare manganese-based ferrite particles (carrier cores). The prepared carrier cores had a number average particle diameter of 35 μm and a saturation magnetization of 70 $Am^2/kg$ under application of a magnetic field of 3,000 ($10^3/4\pi \cdot A/m$).

Next, a polyamide-imide resin (a copolymer of trimellitic anhydride and 4,4'-diamino diphenyl methane) was melt into methyl ethyl ketone to prepare a resin solution. Then, a fluorinated ethylene-propylene copolymer (FEP) as a fluororesin and silicon oxide (2% by mass of total amount of the resin) were dispersed into the resin solution to prepare a carrier coating liquid in an amount of 150 parts by mass in terms of solid content. The prepared carrier coating liquid had a mass ratio between the polyamide-imide resin and the FEP of 2/8 (=polyamide-imide resin/FEP), and the resin solution had a solid concentration of 10% by mass.

Subsequently, the carrier coating liquid was caused to cover 10,000 parts by mass of the manganese-based ferrite particles (carrier cores) using a tumbling fluidized bed coater (SPIRA COTA (registered Japanese trademark) SP-25 produced by OKADA SEIKO CO., LTD.). Thereafter, the manganese-based ferrite particles covered with the resin was baked at a temperature of 220° C. for one hour. The resultant baked substance was cooled and then broken up to prepare a resin-covering ferrite carrier having a resin coverage of 3% by mass.

A color printer (FS-05400DN produced by KYOCERA Document Solutions Inc.) was used as an evaluation apparatus. The developer for evaluation prepared as described above was loaded into a developing device of the evaluation apparatus and a sample (toner) was loaded into a toner container of the evaluation apparatus. A printing durability test was performed by forming 10,000 images at a printing rate of 5%.

(Thermal Blocking Resistance)

For evaluation of thermal blocking resistance of the toner, the above printing durability test was performed in a normal-temperature and normal-humidity environment (temperature: 23° C., relative humidity: 50% RH) and the degree of aggregation was measured on a sample (toner) collected through cleaning during the printing durability test. Specifically, 10 g of a sample collected through cleaning was placed in a constant temperature bath of which temperature was adjusted at 58° C. for eight hours. Then, the placed sample was sifted using a sieve having an opening of 45 μm. The mass of toner remaining on the sieve after sifting was measured. The degree of aggregation (% by mass) of the toner was calculated using the following equation from the mass of toner prior to sifting and the mass of toner remaining in the sieve through the sifting.

Aggregation degree (% by mass)=(Mass of toner remaining in sieve/mass of toner prior to sifting)×100

Thermal blocking resistance of the toner was evaluated from the calculated degree of aggregation in accordance with the following standard.

Good: Aggregation degree of less than 50% by mass.

Poor: Aggregation degree of at least 50% by mass.

(Low-temperature Fixability)

After a printing durability test as described above was performed in a normal-temperature and normal-humidity environment (temperature: 23° C., relative humidity: 50% RH), low-temperature fixability of the sample (toner) was evaluated in a manner that a solid image having a size of 25 mm×25 mm and a printing rate of 100% was formed on paper of 90 $g/m^2$ (A4-size evaluation paper) using the above evaluation apparatus under conditions of a linear velocity of 200 mm/sec. (40 microseconds was taken to pass through a nip) and a toner applied amount of 1.0 $mg/cm^2$. Next, the paper on which the image has been formed was caused to pass through the fixing device. The fixing temperature was set within a range of at least 80° C. and no greater than 180° C. Specifically, the fixing temperature of the fixing device was gradually raised from 80° C. and a lowest temperature that enables fixing of the toner (a solid image) to the paper (minimum fixing temperature) was measured.

Whether or not toner fixing was accomplished in the lowest fixing temperature measurement was checked by a fold-rubbing test as described below. Specifically, the paper with the solid image fixed thereon was folded in half such that a surface with the solid image thereon was folded inwards. A 1 kg weight covered by cloth was rubbed back and forth five times on the fold. Next, the paper was opened out and a folded portion of the paper (portion with the solid image formed) was observed. The length of a part of the fold portion where the toner peeled (peeling length) was then measured. A minimum fixing temperature at which a measured peeling length was less than 1 mm was determined to be a lowest fixing temperature.

Low-temperature fixability of the toner was evaluated using the determined lowest fixing temperature in accordance with the following standard.

Good: Lowest fixing temperature of less than 120° C.

Poor: Lowest fixing temperature of at least 120° C.

(Printing Durability)

A printing durability test as described above was performed in a normal-temperature and normal-humidity environment (temperature: 23° C., relative humidity: 50% RH) for evaluation of printing durability of the toner. A solid image was formed using the evaluation apparatus before and after the printing durability test, and the image density of the formed images was measured using a reflectance densitometer (SpectroEye (registered Japanese trademark) LT produced by SAKATA INX ENG CO., LTD.). The image density was measured for arbitrary ten solid images among the formed solid images. An average value in the image density of the ten images was determined to be an evaluation value for image density. A difference $\Delta ID_1$ in image density between before and after the printing durability test was calculated from an image density $ID_{11}$ before the printing durability test and an image density $ID_{12}$ after the printing durability test based on the following equation.

$$\Delta ID_1=|ID_{11}-ID_{12}|$$

Printing durability of the toner was evaluated from the difference $\Delta ID_1$ in image density calculated as above in accordance with the following standard.

Good: A difference in image density was less than 0.3.

Poor: A difference in image density was at least 0.3.

(Resistance to Environment)

For evaluating resistance to environment of the toner, printing durability was tested in a manner as described above in a low-temperature and low-humidity environment (L/L environment, temperature: 20° C., relative humidity: 65% RH) and in a high-temperature and high-humidity environment (H/H environment, temperature: 32° C., relative humidity: 80% RH). Solid images were formed using the evaluation apparatus after the respective printing durability tests, and the image density of the formed images was measured using a reflectance densitometer (SpectroEye (registered Japanese trademark) LT produced by SAKATA INX ENG CO., LTD.). The image density of arbitrary ten images among the formed solid images was measured. An average value of the image density of the ten images was determined to be an evaluation value for image density. A difference $\Delta ID_2$ in image density originated from environment change was calculated from an image density $ID_{21}$ measured after the printing durability test in the L/L environment and the image density $ID_{22}$ measured after the printing durability test in the H/H environment based on the following equation.

$$\Delta ID_2-|ID_{21}-ID_{22}|$$

Resistance to environment of the toner was evaluated from the difference $\Delta ID_2$ in image density calculated as above in accordance with the following standard.

Excellent: A difference in image density was less than 0.3.

Good: A difference in image density was at least 0.3 and less than 0.5.

Poor: A difference in image density was at least 0.5.

[Evaluation Results]

Tables 5 and 6 indicate evaluation results of thermal blocking resistance and low-temperature fixability for the samples (toners according to Examples 1-30 and Comparative Examples 1-17). Tables 7 and 8 indicate evaluation results of printing durability and resistance to environment for the samples (toner according to Examples 1-30 and Comparative Examples 1-17).

TABLE 5

| | Thermal blocking resistance | Low-temperature fixability |
|---|---|---|
| Example 1 | Good | Good |
| Example 2 | Good | Good |
| Example 3 | Good | Good |
| Example 4 | Good | Good |
| Example 5 | Good | Good |
| Example 6 | Good | Good |
| Example 7 | Good | Good |
| Example 8 | Good | Good |
| Example 9 | Good | Good |
| Example 10 | Good | Good |
| Example 11 | Good | Good |
| Example 12 | Good | Good |
| Example 13 | Good | Good |
| Example 14 | Good | Good |
| Example 15 | Good | Good |
| Example 16 | Good | Good |
| Example 17 | Good | Good |
| Example 18 | Good | Good |
| Example 19 | Good | Good |
| Example 20 | Good | Good |
| Example 21 | Good | Good |
| Example 22 | Good | Good |
| Example 23 | Good | Good |
| Example 24 | Good | Good |
| Example 25 | Good | Good |
| Example 26 | Good | Good |
| Example 27 | Good | Good |
| Example 28 | Good | Good |
| Example 29 | Good | Good |
| Example 30 | Good | Good |

TABLE 6

| | Thermal blocking resistance | Low-temperature fixability |
|---|---|---|
| Comparative Example 1 | Poor | Good |
| Comparative Example 2 | Poor | Good |
| Comparative Example 3 | Poor | Good |
| Comparative Example 4 | Good | Poor |
| Comparative Example 5 | Good | Poor |
| Comparative Example 6 | Good | Poor |
| Comparative Example 7 | Good | Good |
| Comparative Example 8 | Good | Good |
| Comparative Example 9 | Good | Good |
| Comparative Example 10 | Good | Good |
| Comparative Example 11 | Poor | Good |
| Comparative Example 12 | Poor | Good |
| Comparative Example 13 | Poor | Good |
| Comparative Example 14 | Poor | Good |
| Comparative Example 15 | Poor | Good |
| Comparative Example 16 | Good | Good |
| Comparative Example 17 | Poor | Good |

TABLE 7

| | Image density | |
|---|---|---|
| | Resistance to environment | Printing durability |
| Example 1 | Excellent | Good |
| Example 2 | Good | Good |
| Example 3 | Excellent | Good |
| Example 4 | Excellent | Good |
| Example 5 | Excellent | Good |
| Example 6 | Excellent | Good |
| Example 7 | Excellent | Good |
| Example 8 | Excellent | Good |
| Example 9 | Good | Good |
| Example 10 | Good | Good |
| Example 11 | Excellent | Good |
| Example 12 | Excellent | Good |
| Example 13 | Excellent | Good |

TABLE 7-continued

| | Image density | |
|---|---|---|
| | Resistance to environment | Printing durability |
| Example 14 | Excellent | Good |
| Example 15 | Excellent | Good |
| Example 16 | Excellent | Good |
| Example 17 | Excellent | Good |
| Example 18 | Excellent | Good |
| Example 19 | Excellent | Good |
| Example 20 | Excellent | Good |
| Example 21 | Excellent | Good |
| Example 22 | Excellent | Good |
| Example 23 | Excellent | Good |
| Example 24 | Excellent | Good |
| Example 25 | Excellent | Good |
| Example 26 | Excellent | Good |
| Example 27 | Excellent | Good |
| Example 28 | Excellent | Good |
| Example 29 | Excellent | Good |
| Example 30 | Excellent | Good |

TABLE 8

| | Image density | |
|---|---|---|
| | Resistance to environment | Printing durability |
| Comparative Example 1 | Excellent | Good |
| Comparative Example 2 | Excellent | Good |
| Comparative Example 3 | Excellent | Good |
| Comparative Example 4 | Excellent | Good |
| Comparative Example 5 | Excellent | Good |
| Comparative Example 6 | Excellent | Good |
| Comparative Example 7 | Excellent | Poor |
| Comparative Example 8 | Good | Poor |
| Comparative Example 9 | Good | Poor |
| Comparative Example 10 | Excellent | Poor |
| Comparative Example 11 | Excellent | Good |
| Comparative Example 12 | Excellent | Good |
| Comparative Example 13 | Excellent | Good |
| Comparative Example 14 | Excellent | Good |
| Comparative Example 15 | Excellent | Good |
| Comparative Example 16 | Excellent | Poor |
| Comparative Example 17 | Excellent | Good |

The toners according to Examples 1-30 each satisfied conditions (1) as described above. Specifically, in each of the toners according to Examples 1-30: $C_F$ satisfied expression (1); $C_S$ satisfied expression (2); and each of $SP_T$, $SP_F$, and $SP_S$ satisfied expression (3).

The toners according to Examples 1-30 each had excellent evaluation results in thermal blocking resistance, low-temperature fixability, and image density (printing durability test).

In view of the foregoing, the toners according to Examples 1-30 each were excellent in low-temperature fixability and high-temperature preservability when compared with the toners according to Comparative Examples 1-17 and images at an appropriate image density could be formed for a long period of term using the respective toners according to Examples 1-30.

Furthermore, the toners according to Examples 1, 3-8, and 11-30 each included the first shell particles having a particle diameter of at least 30 nm and no greater than 90 nm and the second shell particles having a particle diameter of at least 70 nm and no greater than 300 nm. Yet, the toners according to Examples 1, 3-8, and 11-30 each had excellent evaluation results in image density (resistance to environment). In addition, the toners according to Examples 1, 3-8, and 11-30 each were excellent in charge stability.

What is claimed is:

1. An electrostatic latent image developing toner comprising a plurality of toner particles each including a toner core and a shell layer that covers a surface of the toner core, wherein the shell layer includes a plurality of first shell particles and a plurality of second shell particles, the first shell particles cover the surface of the toner core, the second shell particles additionally cover the toner core covered with the first shell particles, the first shell particles have a coverage ($C_F$) that satisfies a following expression (1), the second shell particles have a coverage ($C_S$) that satisfies a following expression (2), and a solubility parameter ($SP_T$) of the toner core, a solubility parameter ($SP_F$) of the first shell particles, and a solubility parameter ($SP_S$) of the second shell particles satisfy a following expression (3):

$$25\% \leq C_F \leq 50\% \quad (1)$$

$$5\% \leq C_S \leq 30\% \quad (2)$$

$$SP_T > SP_F > SP_S \quad (3).$$

2. The electrostatic latent image developing toner according to claim 1, wherein the first shell particles have a number average particle diameter smaller than the second shell particles, and each of the first and second shell particles has a number average particle diameter of at least 0.005 times and no greater than 0.04 times as a number average particle of the toner core.

3. The electrostatic latent image developing toner according to claim 1, wherein the first shell particles have a number average particle diameter of at least 30 nm and no greater than 90 nm, and the second shell particles have a number average particle diameter of at least 70 nm and no greater than 300 nm.

4. The electrostatic latent image developing toner according to claim 1, wherein the solubility parameter ($SP_T$) of the toner core, the solubility parameter ($SP_F$) of the first shell particles, and the solubility parameter ($SP_S$) of the second shell particles satisfy following expressions (4) and (5):

$$|SP_T - SP_F| \leq 1.0 \quad (4)$$

$$|SP_F - SP_S| \leq 1.0 \quad (5).$$

5. The electrostatic latent image developing toner according to claim 1, wherein the toner core contains a polyester resin as a binder resin, the first shell particles each contain a styrene-acrylic acid-based resin, and the second shell particles each contain a cross-linked styrene-acrylic acid-based resin.

6. The electrostatic latent image developing toner according to claim 1, wherein the toner core has a glass transition point of at least 25° C. and no greater than 45° C., and the toner core is anionic.

7. The electrostatic latent image developing toner according to claim 1, wherein the first shell particles have a glass transition point of at least 60° C. and no greater than 120° C., the first shell particles have a softening point of at least 120° C. and no greater than 210° C., and the first shell particles are cationic.

8. The electrostatic latent image developing toner according to claim 1, wherein the toner particles each contain an external additive.

* * * * *